US010376046B2

(12) United States Patent
Lye

(10) Patent No.: US 10,376,046 B2
(45) Date of Patent: Aug. 13, 2019

(54) MODULAR SHELVING ASSEMBLIES AND METHODS OF CONSTRUCTION

(71) Applicant: Agapitus Lye, Gainesville, FL (US)

(72) Inventor: Agapitus Lye, Gainesville, FL (US)

( * ) Notice: Subject to any disclaimer, the term of this patent is extended or adjusted under 35 U.S.C. 154(b) by 150 days.

(21) Appl. No.: 15/363,409

(22) Filed: Nov. 29, 2016

(65) Prior Publication Data

US 2018/0146776 A1 May 31, 2018

(51) Int. Cl.
*A47B 47/00* (2006.01)
*A47B 73/00* (2006.01)

(52) U.S. Cl.
CPC ..... *A47B 47/0091* (2013.01); *A47B 47/005* (2013.01); *A47B 47/0066* (2013.01); *A47B 73/006* (2013.01); *A47B 2230/07* (2013.01)

(58) Field of Classification Search
CPC . A47B 47/005; A47B 47/0091; A47B 73/006; A47B 2230/07
See application file for complete search history.

(56) References Cited

U.S. PATENT DOCUMENTS 3,528,559 A * 9/1970 Miller ..... E04B 2/7433 211/180
3,841,726 A * 10/1974 Andros ..... A47B 47/0041 211/189
4,118,903 A * 10/1978 Coulthard ..... A47B 57/26 108/152
4,597,231 A * 7/1986 Quest ..... E04B 2/7425 52/239
4,969,568 A * 11/1990 Yoshida ..... B43M 99/008 211/186
5,466,057 A * 11/1995 Blankenburg ..... A47B 47/0041 312/108
7,604,133 B2 * 10/2009 Tsai ..... A47B 73/006 211/189
8,807,356 B2 * 8/2014 Weigand ..... A47F 5/10 211/183
9,016,485 B1 * 4/2015 Liu ..... A47B 47/0075 211/183
9,038,261 B2 * 5/2015 Renaud ..... B25B 5/142 29/525.01
9,320,355 B2 * 4/2016 Lee ..... A47B 73/006
D796,344 S * 9/2017 Paulick ..... D25/115

FOREIGN PATENT DOCUMENTS

DE 29802051 U1 * 4/1998 ..... A47B 73/006
GB 1071700 A * 6/1967 ..... A47B 47/005
WO WO-2012166067 A2 * 12/2012 ..... A47B 47/0041

* cited by examiner

*Primary Examiner* — Stanton L Krycinski
(74) *Attorney, Agent, or Firm* — Saliwanchik, Lloyd & Eisenschenk

(57) ABSTRACT

A shelving assembly can be constructed of panels and specialized connecting components that form interconnected hexagonal, triangular, or square cells. The shelving assembly can be adapted to a variety of sizes and configurations and can incorporate smaller cells with larger cells and different shape cells for more modularity. The connecting components attach to the front and rear edges of the panels without special tools. The connecting components also connect the corners of cell shapes and provide strength to the overall structure. The shelving assembly can be completely disassembled into the panels and the connecting components, allowing the shelving assembly to be easily moved and reconstructed.

13 Claims, 14 Drawing Sheets

Note:
All Dims in Inches

Note:
All Dims in Inches

Note:
All Dims in Inches

MODULAR SHELVING ASSEMBLIES AND METHODS OF CONSTRUCTION

BACKGROUND OF INVENTION

Shelving units that can be assembled from preconfigured pieces have been used in homes and industry for decades. These units often have premade shelves for horizontal attachment to vertical supports and are assembled with various types of clips, connectors, or other components into the designed unit. The strength of these types of shelving units is usually dependent upon the type of materials utilized for the individual components.

Modular shelving is also known and commonly used. This type of shelving often employs individual pre-made pieces that can be fit together in various combinations. Modular shelving can allow more individual expression and personal style, but is often bulkier and harder to attach because the pieces are pre-assembled or at least partially pre-assembled.

A shelving unit that can be easily assembled from smaller pieces and provide modularity to the final design would be easier to transport and would allow more customization of the final assembly.

BRIEF SUMMARY

The subject invention addresses the need for a shelving assembly that can be constructed from preconfigured, connectable parts that also incorporates modularity and variation by allowing for modification of the design to suit individual needs and style.

Advantageously, the connecting components of a shelving assembly of the subject invention can be attached to panels that form the walls of a shelving assembly without the use of tools or other devices. If the design of the shelving assembly needs to be changed, the connectable shelving pieces of a shelving assembly can be easily disassembled and reconfigured into a new arrangement. The connecting components can also provide strength to the shelving assembly by providing rigidity and tension between the corners of the panels that can assist in maintaining the overall form and structure of the shelving assembly. Furthermore, because of the construction method that can be used, the level of tolerance between the connecting components and the panels can be minimized, which can further enhance the stability and rigidity of the overall shelving assembly.

The shelving assembly of the subject invention has a further advantage in that the preconfigured pieces can be assembled into cells of hexagonal, triangular, or square shape, which imparts superior strength and stability to the shelving assembly, regardless of the size or the number of cells. These shapes also provide the desired modularity because smaller cells can be combined with larger cells to form a variety of configurations. For example, there can be partial hexagonal cells formed in a shelving assembly as well, such as around the periphery of the assembly or different shape cells can be combined, such as, for example, triangular cells combined with square cells.

The connecting components of the subject invention can be easily attachable to the panels that form the walls of the cells. The connecting components can be attachable along the shorter sides, which is usually the front edge and back edge, of the panels, so that the connecting components and panels are more easily aligned and slide along a shorter distance. The connecting components can also attach each cell to another adjacent cell, so that cells share one or more walls, similar to the cells of a beehive. The connecting components can also have anti-warp indents that not only aid in the manufacture of the connecting components, but ensure a finished form that is rigid and linear that can be easily slid or pushed over the ends of the panels.

Certain connecting components can include a cross-brace extending from each side of the connecting component. The cross-brace on one side can connect to a cross-brace on another connecting component. The cross-braces can extend across and be connected across the rear of a cell, so that they span the opening in a cell. This connection of cross-braces can help stabilize the structure. The cross-braces can also have weak points or frangible areas where they can be broken off close to the connector portion. Cross-braces that are not utilized can be broken off of the connecting component, if desired. This can remove individual, unneeded cross-braces extending out from the sides of a structure or across a cell opening.

When properly constructed according to the methods of the subject invention, the connecting components and panels can be joined into a shelving assembly having any number of hexagonal, triangular, and/or square shaped cells. The connectable shelving parts can be configured in sizes that allow interchangeability and the integration of smaller cells formed alongside larger cells providing modularity for complete customization of a unit.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIG. 2A shows the connecting components with the cross arms and support arms and an exploded view showing how the cross arms and support arms can be snapped off FIG. 2B show the shelving assembly with the cross arms and support arms snapped off.

FIG. 3A is a perspective view. FIG. 3B is a back face view. FIG. 3C is a top plan view. FIG. 3D is a side view.

FIG. 4A is a perspective view. FIG. 4B is a back face view. FIG. 4C is a top plan view. FIG. 4D is a side view.

FIG. 5A is a perspective view. FIG. 5B is a back face view. FIG. 5C is a side elevation view. FIG. 5D is side elevation view with the side clip rotated 90°. FIGS. 5E and 5F are enlarged views of the chamfered corners.

FIG. 6A is a perspective view.

FIG. 6B is a back face view. FIG. 6C is a top plan view. FIGS. 6D and 6E are enlarged views of the chamfered corners. FIG. 6F is a side view.

FIG. 7A is a perspective view.

FIG. 7B is a back face view. FIG. 7C is a top plan view. FIG. 7D is a side view.

DETAILED DISCLOSURE

Figure 1:
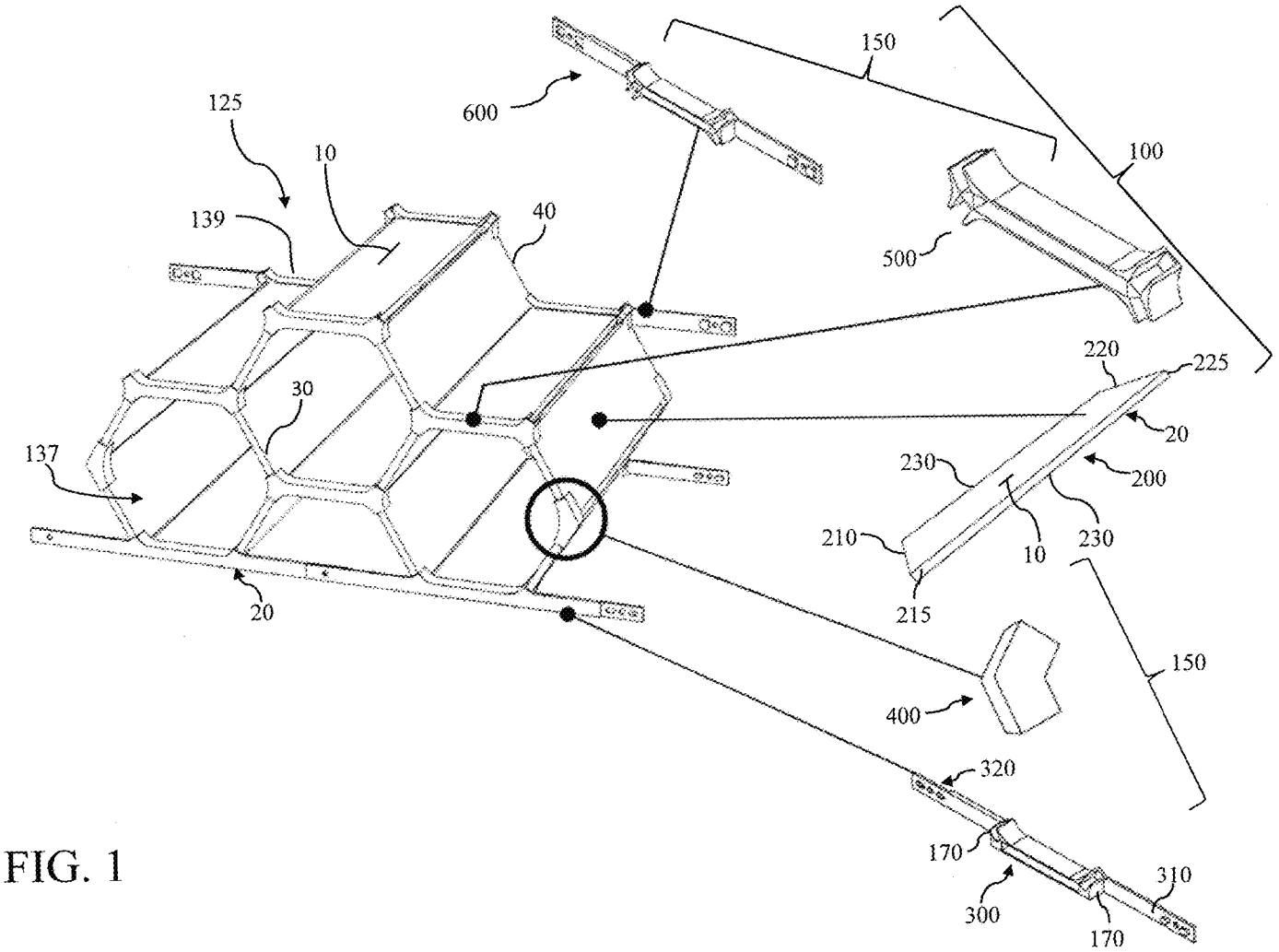
FIG. 1 is a perspective view of an embodiment of a shelving assembly, according to the subject invention. Also shown is an exploded view of certain embodiments of the shelving parts.

The subject invention pertains to shelving units that can be assembled from individual preconfigured, connectable parts. More specifically, the subject invention provides modular shelving assemblies formed of hexagonal, triangular, or square cells capable of providing a strong, stable structure. Advantageously, the shelving parts can be assembled into cells to provide a structure that can be customized with different sizes of cells and that can be completely disassembled into the individual parts for compact storage or reassembly into a new arrangement of hexagonal cells.

The ability to construct, or deconstruct, an entire shelving unit from smaller, individual, compact, connectable parts provides not only modularity to the device, but makes it convenient to move or store. Furthermore, the individual parts can be scaled up or down in size during manufacturing without redesign, such that all sizes and types of cells can be constructed by the same or a similar method.

In the description that follows, a number of terms are utilized. In order to provide a clear and consistent understanding of the specification and claims, including the scope to be given such terms, the following definitions are provided.

The terms "assembly" and "shelving assembly" are used interchangeably herein and refer to the assembled collection of shelving parts utilized to construct one or more hexagonal cells into a stable structure.

The term "connecting components" refers, in general, to the collection of clips described herein that are used to attach panels of one or more materials to form hexagonal, triangular, and/or square shaped cells.

The terms "parts" or "shelving parts" are used interchangeably herein for literary convenience and refer jointly to the connecting components and panels, before being connected into a shelving assembly.

Reference is made throughout the application to the "bottom side" and the "top side." For the discussion herein, these terms will be used in reference to a shelving assembly, wherein the bottom side is that end against or nearest to a surface on which the shelving assembly is placed. Conversely, the top side is that end which is furthest from a surface on which the shelving assembly is placed. Thus, understanding this, reference to the bottom side or the top side of any component or part of a shelving assembly is understood to be in reference to the orientation of that component or part on a shelving assembly.

Further, reference is made throughout the application to the "front face" and "back face." For the discussion herein, these terms will also be used in reference to a shelving assembly, wherein the front face is that vertical side or vertical edge through which items or materials can be inserted into a cell of a shelving assembly. Conversely, the back face is the vertical side or vertical edge that is opposite to the front face and on which a cross-brace, when used, extends across a cell opening. Typically, if a shelving assembly is placed against another structure, such as, for example, a wall, the front face is directed away from the structure and the back face is against or nearest to the structure. Thus, understanding this, reference to the front face or back face of any component or part of a shelving assembly is made in reference to the orientation of that component or part when on a shelving assembly.

In addition, as used herein, and unless otherwise specifically stated, the terms "operable communication," "operable connection," "operably connected," "cooperatively engaged" and grammatical variations thereof mean that the particular elements are connected in such a way that they cooperate to achieve their intended function or functions. The "connection" or "engagement" may be direct, or indirect, physical or remote.

The figures and descriptions of embodiments of the present invention have been simplified to illustrate elements that are relevant for a clear understanding of the invention, while eliminating, for purposes of clarity, other elements that may be well known. Those of ordinary skill in the art will recognize that other elements may be desirable and/or required in order to implement the present invention. However, because such elements are well known in the art, and because they do not facilitate a better understanding of the present invention, a discussion of such elements is not provided herein.

The present invention is more particularly described in the following examples that are intended to be illustrative only because numerous modifications and variations therein will be apparent to those skilled in the art. As used in the specification and in the claims, the singular for "a," "an" and "the" include plural referents unless the context clearly dictates otherwise.

Reference will be made to the attached figures on which the same reference numerals are used throughout to indicate the same or similar components. With reference to the attached figures, which show certain embodiments of a the subject invention, it can be seen in FIGS. 1, 14A, and 15A that a shelving assembly 125 of the subject invention can comprise multiple panels 200 that are joined together with connecting components 155 to form interconnected cells 130. The connecting components can advantageously engage the front edges 210 and front corners 215 and the rear edges 220 and rear corners 225 of the panels, such that the side edges of the joined panels are substantially parallel to each other. The connecting components can include a bottom clip 300, a side clip 400, a front clip 500, and a back clip 600, all of which engage with the front edges and/or the rear edges of the panels 200. Each of these general components can have specific features or one or more sub-components, which will be discussed in detail below.

The panels 200 that are joined together using the connecting components 155 of the subject invention can be made of any material suitable for the intended purpose of the shelving assembly 125. For example, wood or wood products can be selected for their economy, light weight, and availability. Metals, plastics, nylon, glass, ceramic, or other materials can also be utilized for strength, aesthetics, or other desirable properties. It can be helpful for the selected material(s) to have sufficient rigidity that the panels do not bend, flex, bow, twist, or otherwise distort in shape to the point where they become disengaged from the connecting components. The rigidity of the panels can also assist with the attachment of the connecting components, which are pressed or rocked side-to-side onto and/or slid across the ends of the panels. Both the panels and connecting components can comprise materials of sufficient rigidity and that are compatible for being attached and maintaining the shape of a shelving assembly. It is within the skill of a person trained in the art to determine which materials are suitable for the panels and connecting components of the subject invention.

Embodiments of the connecting components 155 of the subject invention utilize channels 160 and/or offsets 165, which are spaces or voids in the connecting components into which can be inserted the front edge 210 and front corners 215 and the rear edge 220 and the rear corners 225 of a panel 200. The channels and offsets are defined by the walls 170 of the connecting components, as shown, for example, in FIGS. 3B, 4B, 5B, 6B, 7B, 14B, and 15B. The unique configuration of the channels and the offsets, combined with the panels, can create the hexagonal, triangular, and square shape cells 130 that can make up a shelving assembly 125 of the subject invention.

Connecting components 155 can be used to construct a shelving assembly 125 with hexagonal, triangular, or square shaped cells 130. The following description is directed to a method for constructing a shelving assembly of hexagonal shaped cells. The same or similar method can also be used for constructing a shelving assembly with triangular or square shaped cells.

In one embodiment, a hexagonal connecting component 150 can have one channel 160 and an offset pair 650 at either end of the channel, where one offset 165 can be directed at or towards about the top side 10 and the other offset is directed at or towards about the bottom side 20. With this embodiment, the internal angle between a channel and an offset can be about 120°. When six panels are attached utilizing this embodiment of hexagonal connecting components of the subject invention, the result can be a hexagonal cell, as shown, for example, in FIGS. 1, 8, 12, and 13.

Furthermore, the dimensions of the channels 160 and offsets 165 can determine the size of the panels that can be attached and, thus, the diameter D of each cell in a shelving assembly. As mentioned above, panels can be constructed of any of a variety of materials or combinations thereof. The dimensions of the channels and offsets can be dictated by the type of material utilized and the final dimensions of the panels. Advantageously, the connecting components 155 can be attached along the shorter edges of a panel, which are typically the front edge 210 and the rear edge 220. By utilizing the shorter edges, the channels and offsets can be more easily aligned and the distance and surface area over which the connecting components can slide across is also reduced. This can make the construction process easier and faster and the hexagonal cell structure provides a strong, stable shelving assembly.

Figure 3A:
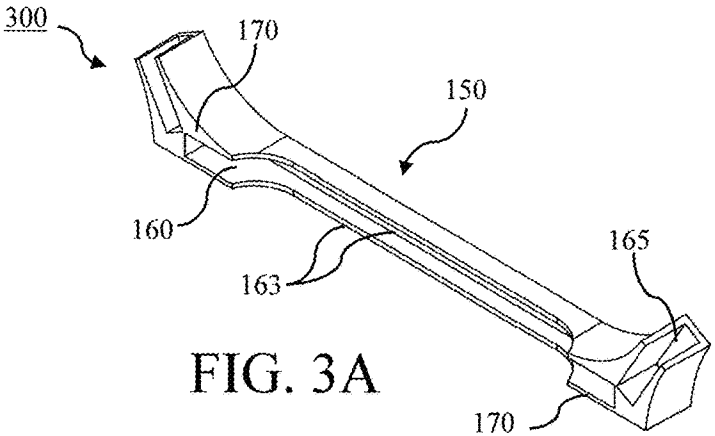
FIGS. 3A, 3B, 3C, and 3D show different views of an embodiment of a bottom clip with cross arms, according to the subject invention.
Figure 3D:
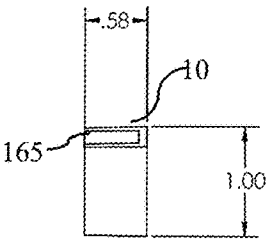
Figure 3C:
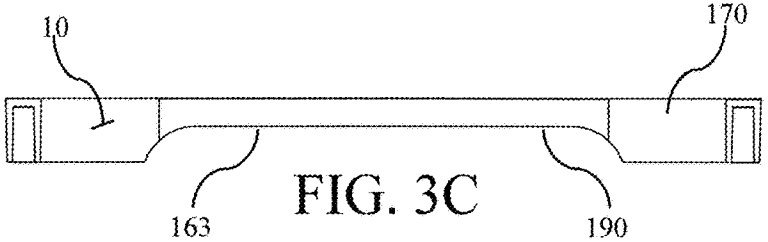
Figure 3B:
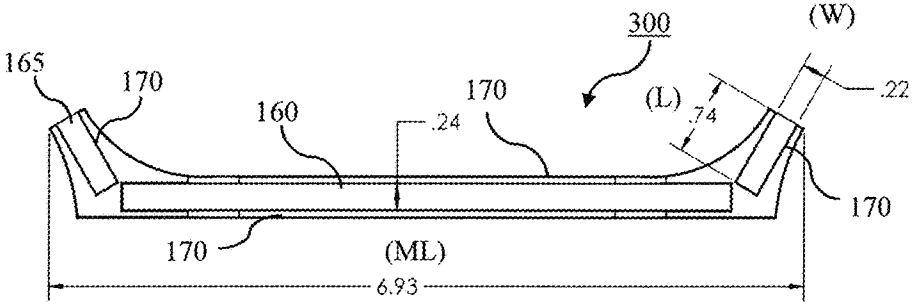
Figure 5A:
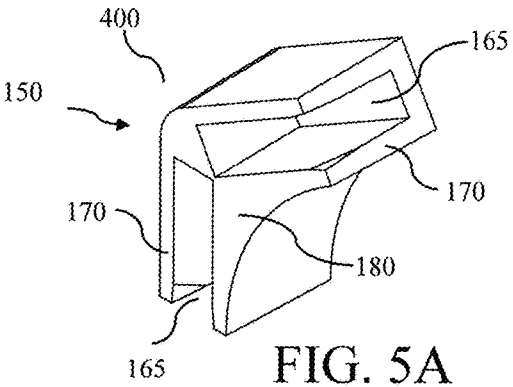
FIGS. 5A, 5B, 5C, 5D, 5E, and 5F show different views of an embodiment of a side clip, according to the subject invention.
Figure 5C:
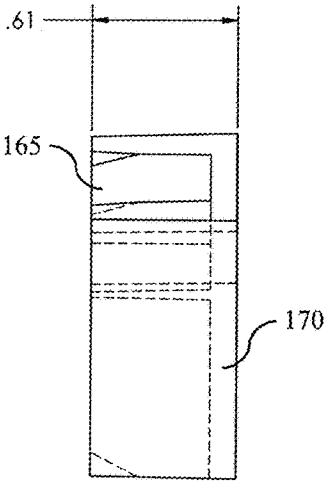
Figure 5E:
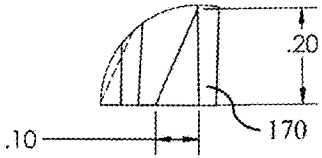
Figure 5F:
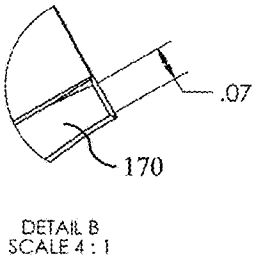
Figure 5D:
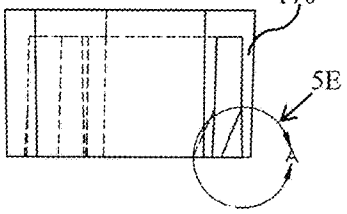
Figure 5B:
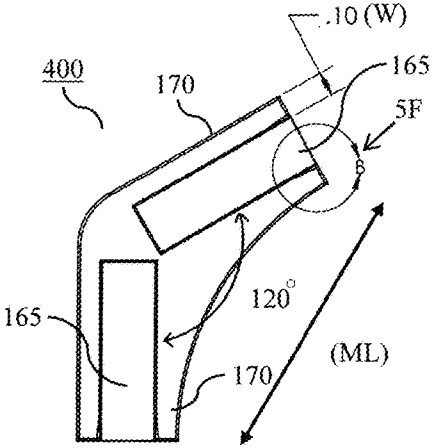
Figures 6A, 6B, 6C, 6D, 6E, 6F:
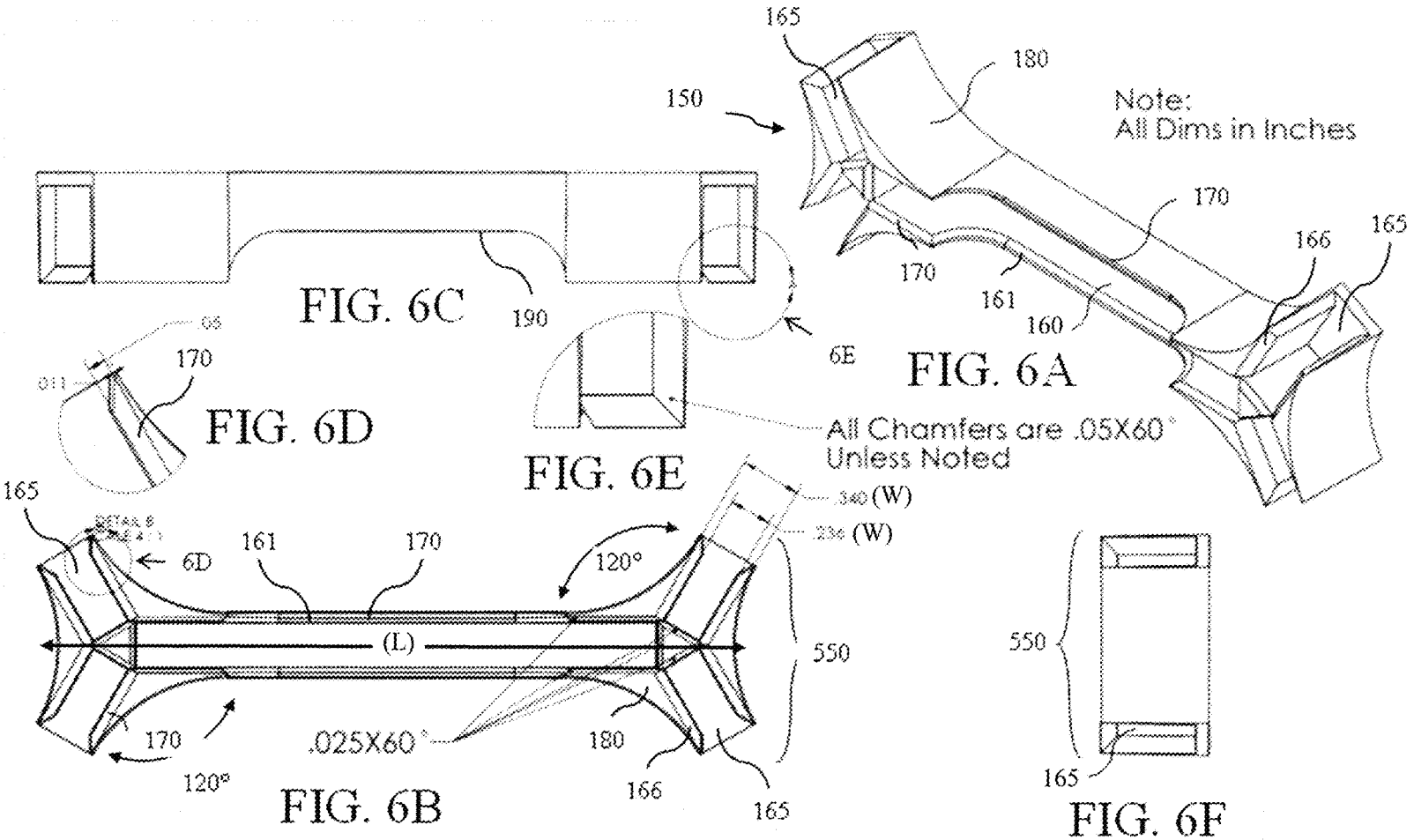
FIGS. 6A, 6B, 6C, 6D, 6E, and 6F show different views of an embodiment of a front clip without support arms, according to the subject invention.
Figure 7A:
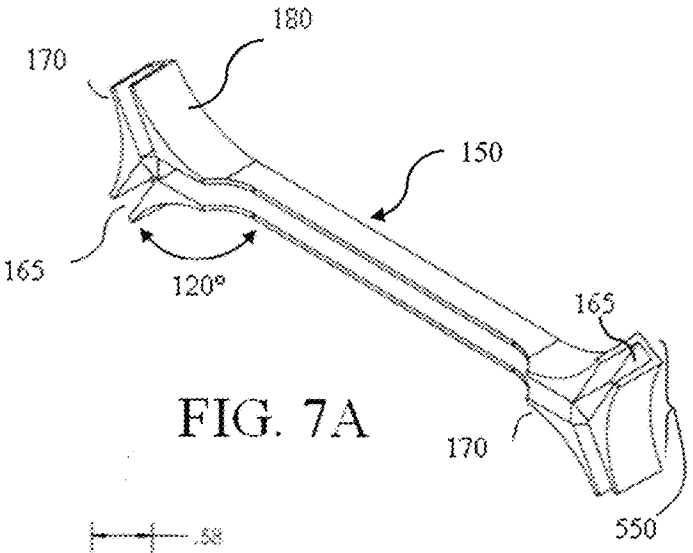
FIGS. 7A, 7B, 7C, and 7D show different views of another embodiment of a front clip without support arms, according to the subject invention.
Figure 7D:
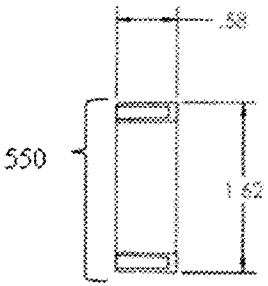
Figure 7C:
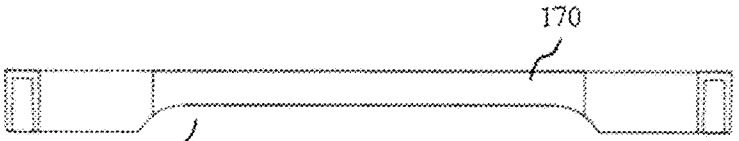
Figure 7B:
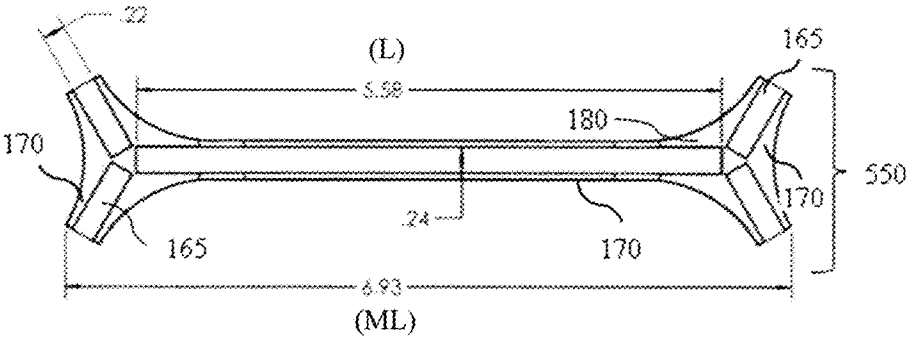
Figures 15A, 15B:
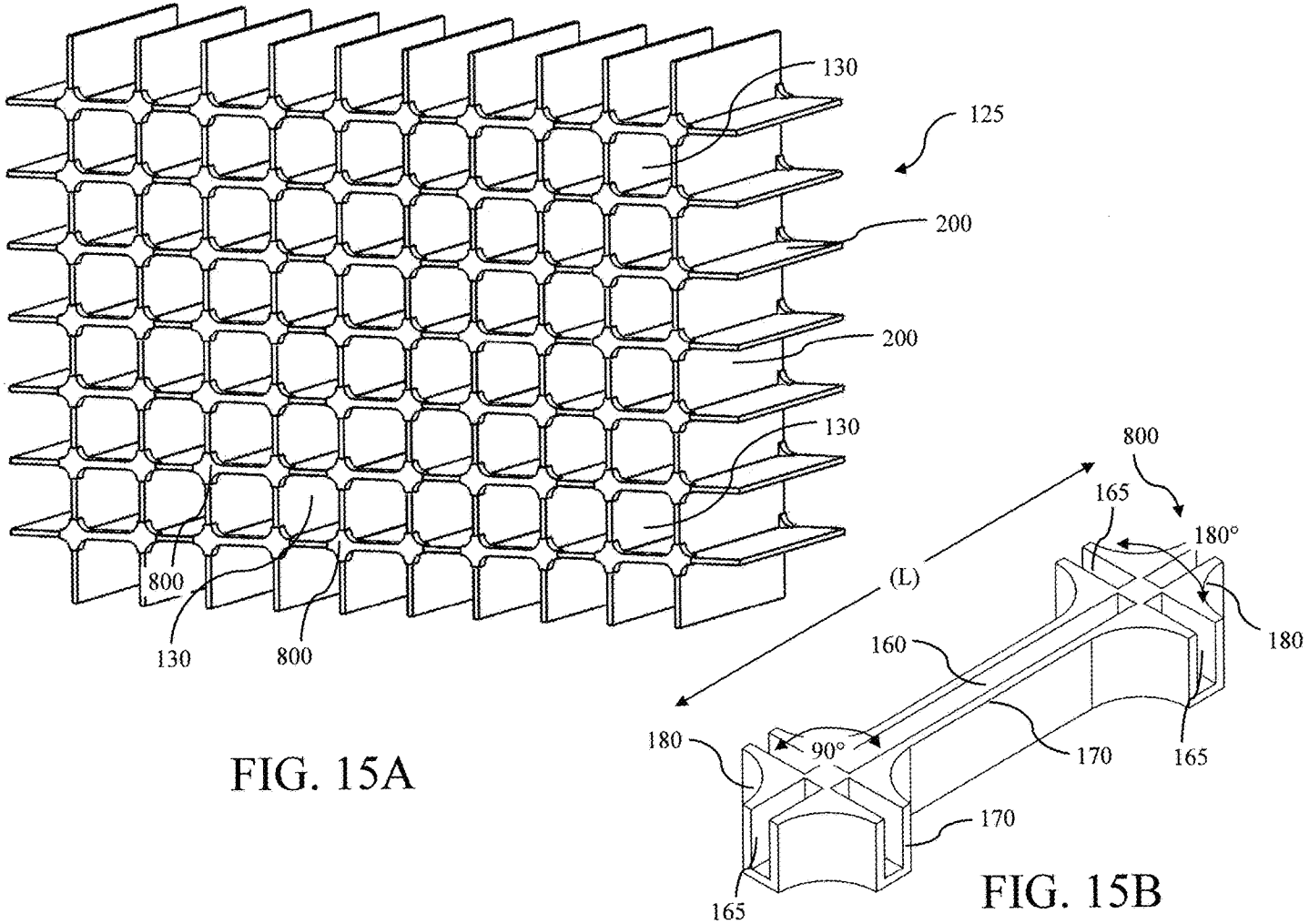
FIGS. 15A and 15B illustrate an embodiment of a clip for constructing a shelving assembly with interconnected square cells.

The maximum length ML of a connecting component can be the maximum distance between two offsets located at each end of a channel, as shown, for example, in FIGS. 3B, 5B, and 15B. In one embodiment, the maximum length can be at least 0.5", 1", 2", 3", 4", 5", 6", 7", 8", 9", 10", 11", 12", 13", 14", 15", 16", 17", 18", 19" and 20" and any length in a range between any of the two listed lengths. Other lengths (L) of a connecting component, such as, for example, the length of a channel 160, as shown in FIG. 6B or the length (L) of an offset 165, as shown in FIG. 3B can also be any length in a range between any of the two above listed maximum lengths.

The width (W) of a connecting component, or features thereof, can refer to the distance between any two walls, as shown, for example, in FIGS. 3B, 5B, 6B, and 11. In one embodiment, the width can be at least 0.05", 0.06", 0.07", 0.08", 0.09", 0.1", 0.2", 0.3", 0.4", 0.5", 0.6", 0.7", 0.8", 0.9", 1.0", 1.1", 1.2", 1.3", 1.4", and 1.5" and any width in a range between any of the two listed widths.

By way of example, FIG. 5B illustrates an embodiment of a front clip 500 used to construct hexagonal shaped cells that is approximately 6.93 inches in total maximum length (ML), where the length (L) of the channel is approximately 5.58 inches in length and approximately 0.24 inches in width, with two offsets at either end of the channel having a width of approximately 0.22 inches each. Conversely, FIG. 6B illustrates a larger embodiment of a front clip 500 that has two offsets at either end of a channel, wherein the width of the offsets in this embodiment are approximately 0.236 inches.

Thus, it can be seen from these examples that the dimensions of a connecting component 155, including the channels 160 and offsets 165, can vary. It is within the skill of a person trained in the art to determine the appropriate dimensions for the channels and offsets of the connecting components. Any variations in the dimensions which provide the same functionality, in substantially the same way as described herein with substantially the same results are within the scope of this invention.

In one embodiment, the panels have the same thickness T between the top side 10 and the bottom side 20. A shelving assembly constructed of uniform sized panels 200 can have channels 160 and offsets 165 that are the same, or approximately the same, width. In an alternative embodiment, there can be panels 200 of different thicknesses. For example, the panels used for the top side 10 and bottom side 20 of a cell can be thicker than the panels 200 used for the sides of a hexagonal cell. With this embodiment, the width of the channels of a connecting component can be larger than the width of the offsets.

The factors that can be considered by those skilled in the art with regard to the choice of materials for the panels 200 used with a shelving assembly of the subject invention have been discussed above and are reasserted here with regard to the connecting components 155. In a particular embodiment, the connecting components are made of a rigid plastic. In a specific embodiment, the connecting components are made of acrylonitrile butadiene styrene (ABS).

Figure 13:
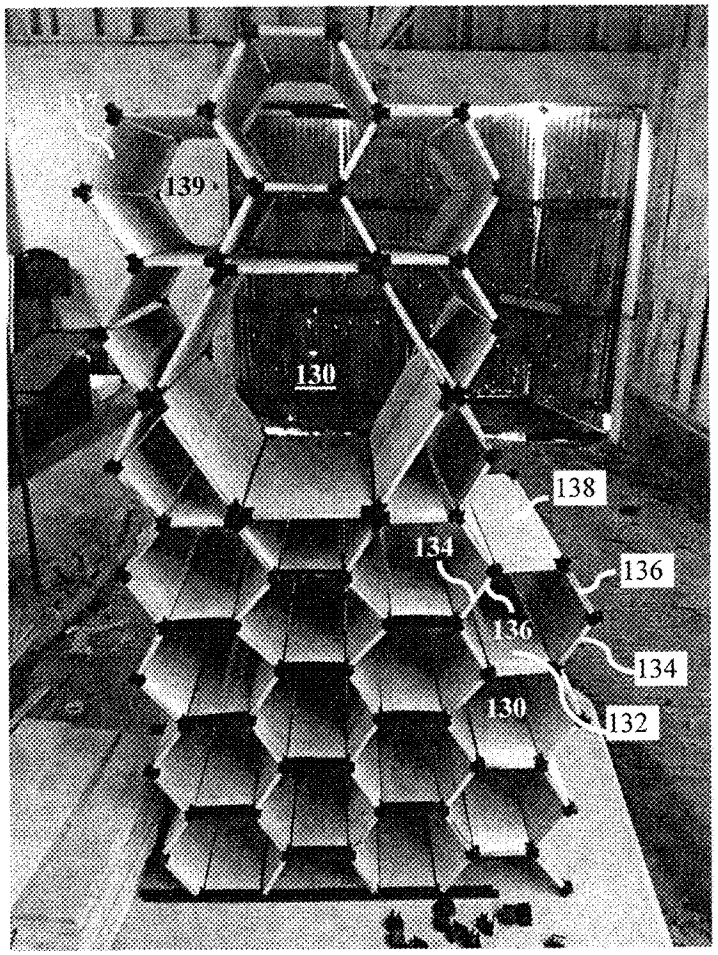
FIG. 13 is a photograph showing the shelving assembly embodiment in FIG. 12 customized to have additional hexagonal cells added to the top and side.
Figure 12:
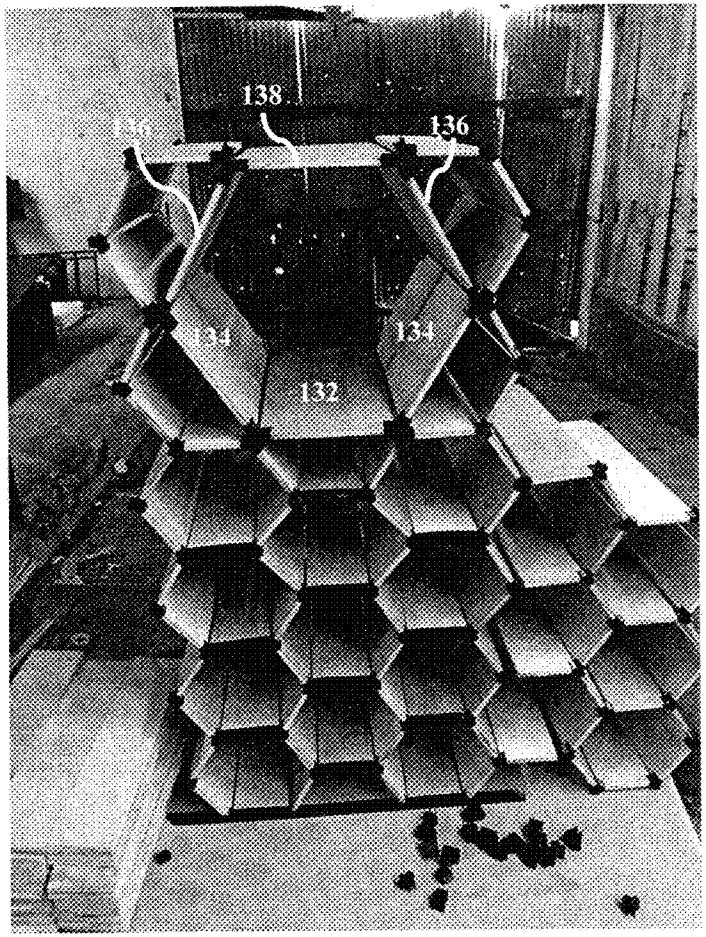
FIG. 12 is a photograph showing an embodiment of a shelving assembly having different size hexagonal cells.

In one embodiment, the connecting components 155 can be employed with panels to construct a shelving unit with hexagonal shaped cells. Each hexagonal cell 130 in a shelving assembly can have a floor 132 at the bottom side 20 of each cell, a lower sidewall 134, an upper side wall 136, and a cover side 138 at the apex or top side 10 of the cell. FIGS. 12 and 13 illustrate the locations of these panels 200. When multiple hexagonal cells are formed, any one or more of the panels 200 that form the floor, walls, and cover of a hexagonal cell can be shared with an adjacent hexagonal cell. FIG. 13 shows how the upper side wall 136 of one cell can form the lower side wall 134 of an adjacent cell.

Figure 8:
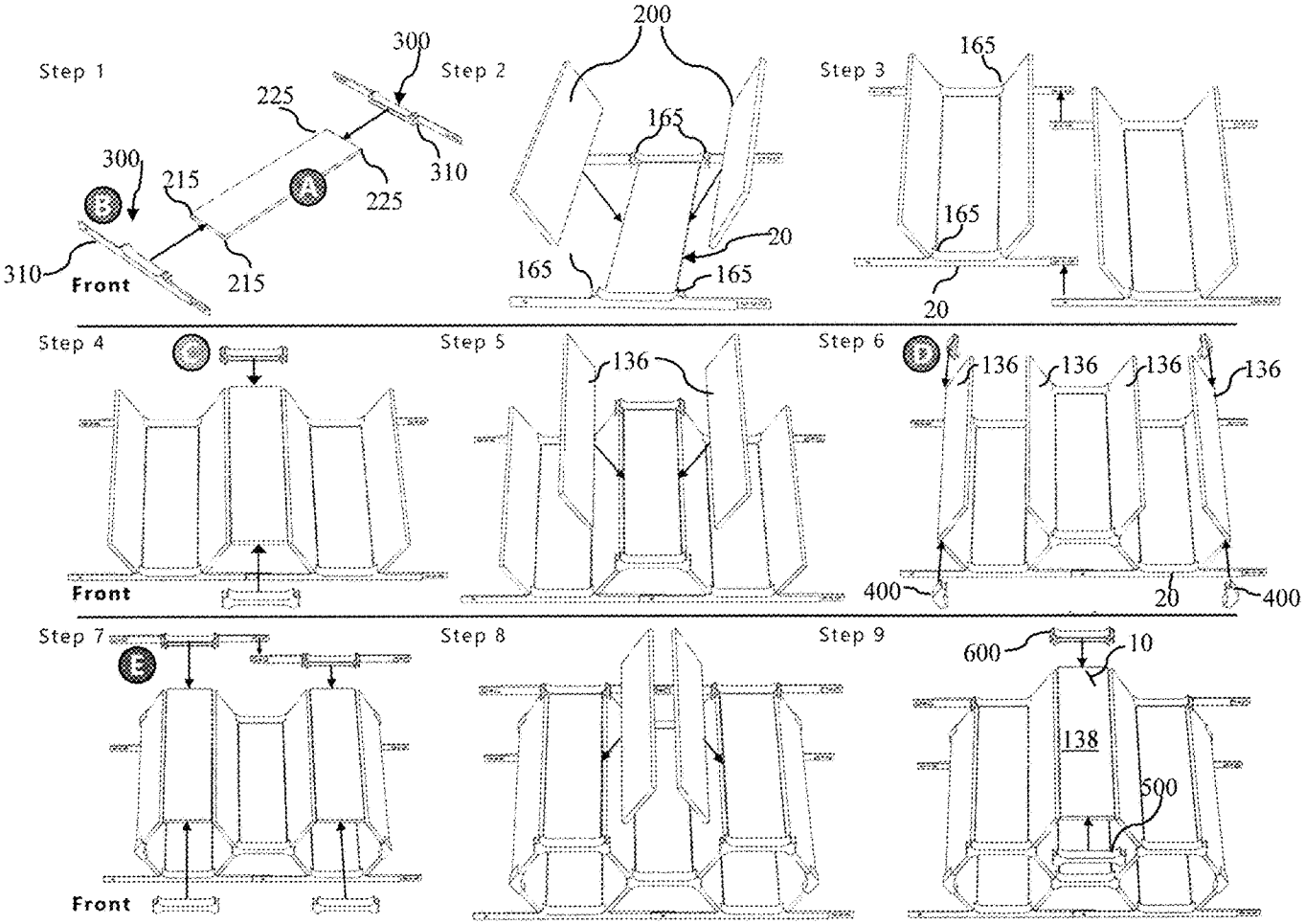
FIG. 8 illustrates one embodiment of a method for constructing a shelving assembly from the shelving parts shown in FIG. 1.

FIG. 8 illustrates one, non-limiting, method for constructing a multi-hexagonal cell shelving assembly. A similar method can be used to construct a shelving assembly with triangular and square shaped cells, utilizing the triangular connecting component 700 and the square connecting component 800 described below. While it is possible to construct a shelving assembly by attaching the connecting components 155 and panels 200 in practically any order, it can be beneficial to start from the bottom side 20 and work upwards to the top side 10. If this method is utilized for hexagonal cells, a bottom clip 300 can be used first, as shown in Step 1 in FIG. 8. A partial hexagonal cell 131 can be formed with the shelving parts 100, particularly around the periphery 5 of a shelving assembly 125 and in areas where smaller hexagonal cells are joined to larger hexagonal cells.

In one embodiment, a bottom clip 300 has one channel 160 for receiving one of the edges of a panel. In a further embodiment, the bottom clip 300 has one offset 165 at either end of the channel 160, where the offsets are directed towards the top side 10. Each offset forms a 120° angle with the channel, as shown, for example, in FIGS. 3B and 4B. A bottom clip 300 can be attached to the front edge 210 and the rear edge 220 of a panel, as shown in Step I of FIG. 8. After attaching one bottom clip to the front edge 210 of a panel and another bottom clip to the rear edge 220 of the panel, this floor 132 can be placed horizontally on a surface with the offsets directed upwards, towards the top side 10. This can allow the wall 170 on the bottom side 20 of the bottom clip to rest against the surface.

For the purposes of constructing a shelving assembly 125 of multiple hexagonal cells 130, it can be helpful to construct all of the cells that will form the floors 132 of the hexagonal cells on the bottom side 20 of the assembly. As the shelving assembly is constructed, the weight of the assembly 125 will increase placing more force against the panels and the bottom clips. To inhibit the cells on the bottom side 20 of the assembly from bowing, sagging, separating, or otherwise coming apart due to the weight of other cells on top of them, a bottom clip can include at least one cross arm 310. In one embodiment, a cross arm 310 extends out from the wall 170 at either end of a bottom clip, as shown, for example, in FIGS. 1, 8, 9, and 10. In a more specific embodiment, a cross arm is substantially coplanar or colliner with the channel 160 of a bottom clip, which can be seen by way of example, in FIGS. 9 and 10. When the bottom clip is attached to a panel, a cross arm can be substantially parallel to a floor panel 132.

FIG. 13 illustrates how hexagonal cells that are interconnected form a three-dimensional structure of stacked cells that alternate with the ones next to it. So, the vertical columns line up, but the individual cells alternate with the cell in the column next to it. In one embodiment, a cross arm 310 of one bottom clip 300 can overlap a cross arm of another bottom clip that is beside or aligned with it, usually attached to another panel 200. Where the arms overlap they cross the front face opening 137 or the back face opening 139 of a whole or partial hexagonal cell, as shown in the example in FIG. 1. Where a partial hexagonal cell is formed, the cross arms can contact the surface on which the shelving assembly is placed, providing additional support and balance, as shown in FIGS. 8 and 13.

Figure 2A:
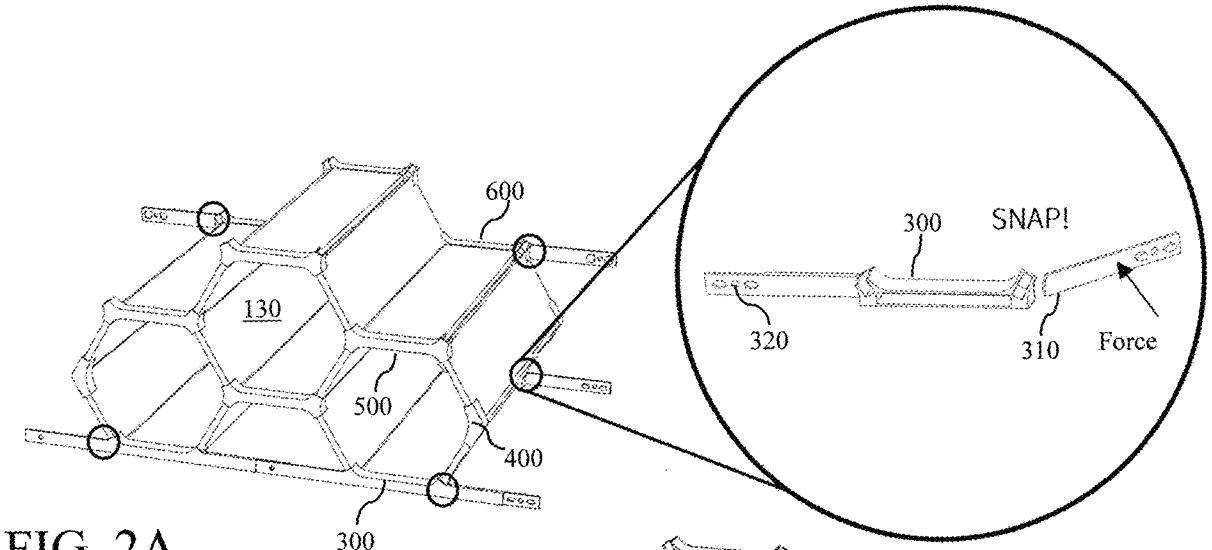
FIGS. 2A and 2B are perspective views of an embodiment of a shelving assembly, according to the subject invention.

In a further embodiment, the overlapping cross arms have one or more locking mechanisms 320 by which the arms can be linked or joined together. Locking mechanisms can be any device or structure that can interlink, connect, lock, fasten, couple, or otherwise join together two arms. For example, FIGS. 1 and 2A illustrate non-limiting examples of a snap closure arrangement where one arm 360 on a bottom clip 310 has male detents and the opposite arm has female slots. When the cross arms on adjacent bottom clips overlap, the male detents can snap into the female slots and join the arms together.

Figure 9:
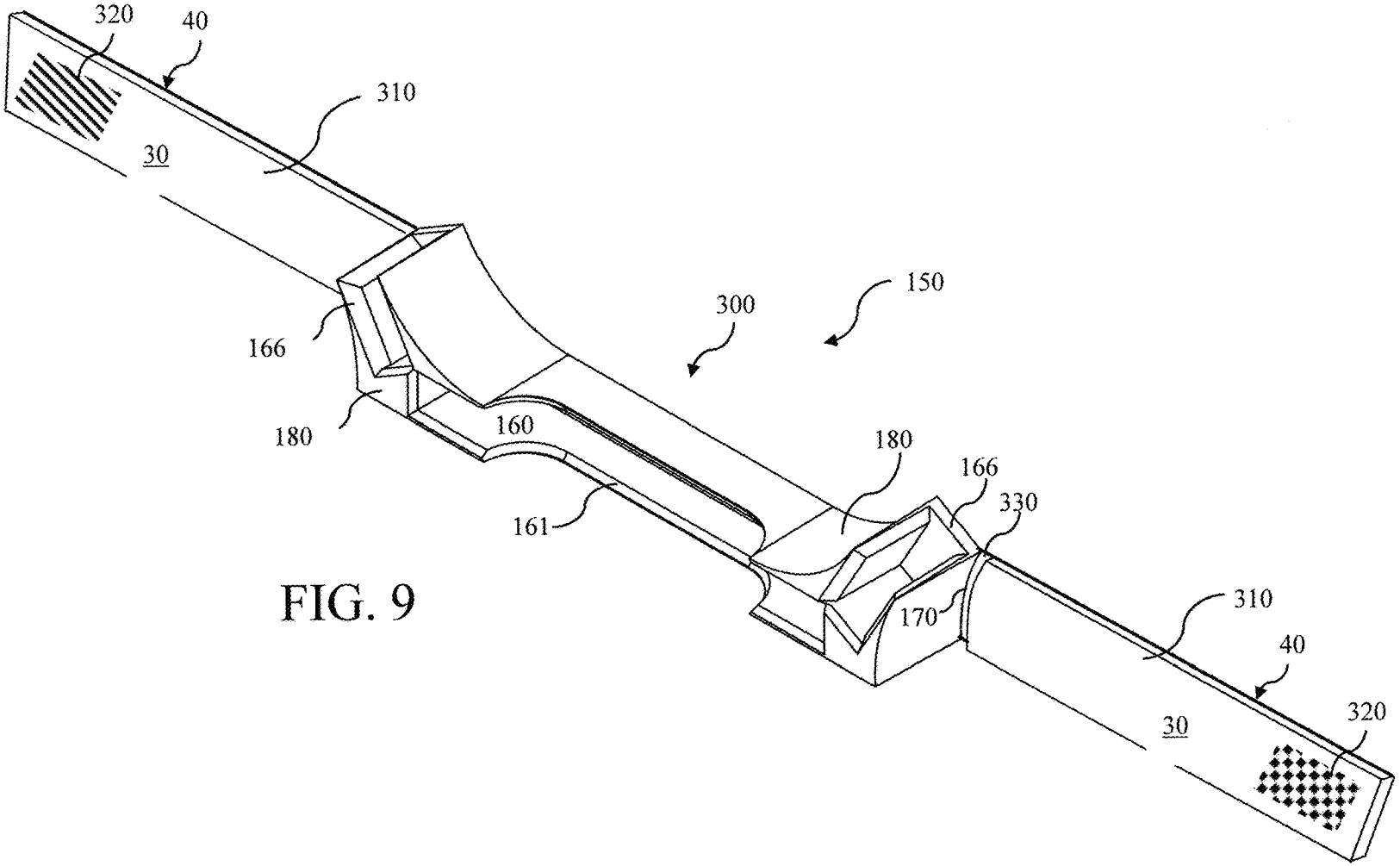
FIG. 9 is a perspective view of an embodiment of a bottom clip with the cross arms attached, according to the subject invention.
Figure 10:
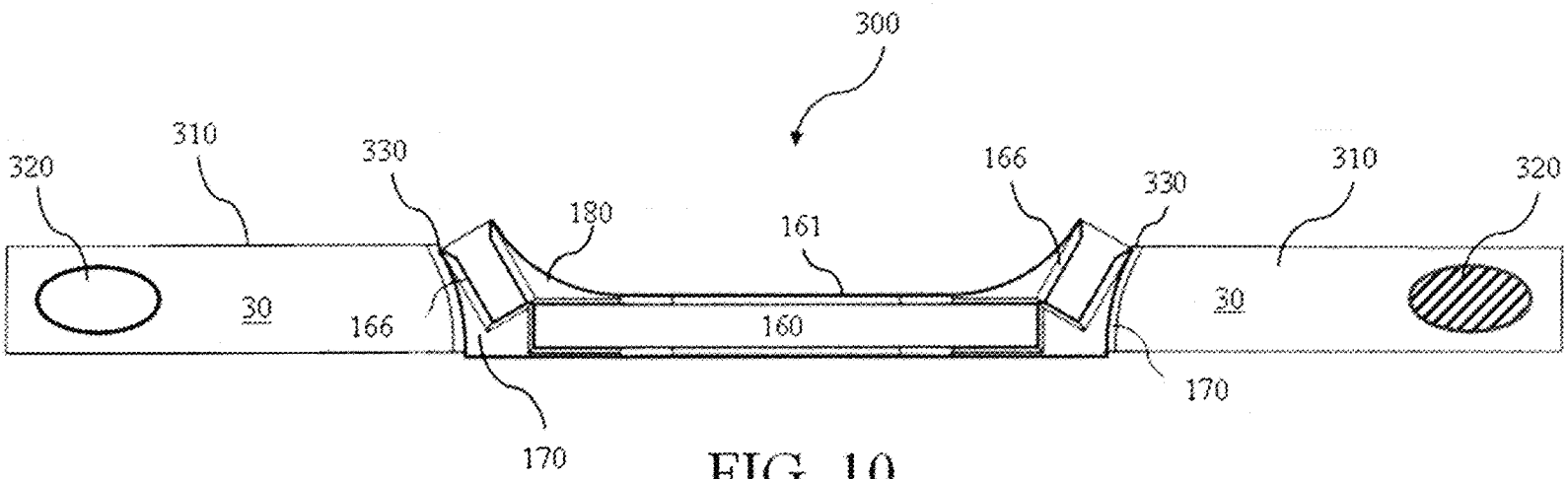
FIG. 10 is a front face view of an embodiment of a bottom clip with the cross arms attached, according to the subject invention.

FIGS. 9 and 10 illustrate non-limiting examples of other types of locking mechanisms 320 that can also be used, for example, but not limited to, hook and loop material, buttons, clips, ratchet mechanism, magnetic connectors, ties, or any other components that can inhibit two arms from being pulled or forced apart. The linked cross arms can hold together the panels 200 on the bottom side 20 and inhibit moving or shifting apart when additional hexagonal cells are constructed on top of the lowermost hexagonal cells. FIG. 2A illustrates one example of bottom clips 300 engaged with the front edges 210 of two panels and the cross arms 310 are overlapped and locked together with a locking mechanism 320.

When bottom clips 300 are used along the outside of a shelving assembly, the cross arms 310 can extend out past the hexagonal cell. It can be desirable to remove the cross arms that can protrude along the outside. Removing the cross arms can give the overall construction a cleaner line and improved appearance. In a further embodiment, the cross arms have a frangible crease 330 in the cross arm, at or near to the wall 170, one example of which is shown in FIGS. 9 and 10. The frangible crease can be used to break or snap off a cross arm from the bottom clip, as illustrated, for example, in FIG. 2A. In one embodiment, the frangible crease is configured so that force applied along the general longitudinal length or generally in-line with the cross arm, will not disconnect the cross arm from the bottom clip. In other words, pulling on the cross arm does not cause the cross arm to disconnect from the clip. Force applied against the front face 30 or the back face 40 of a cross arm will cause the cross arm to bend at the frangible crease and move in the direction of the applied force. Sufficient force applied to one of the faces, or a force applied perpendicular to the cross arm, can cause the cross arm to snap off or break off of the bottom clip, along the frangible crease. This is illustrated by way of example in FIG. 2A.

Figure 2B:
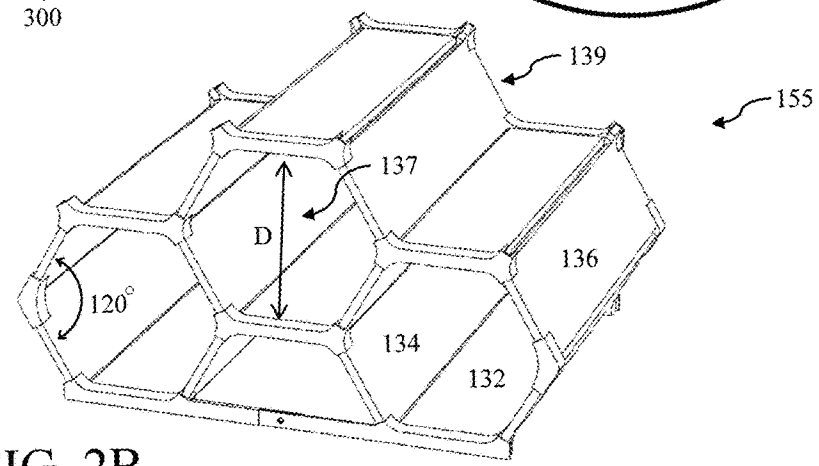

In one embodiment, the shape or path of the frangible crease 330 is complementary to the shape of the wall to which it is attached. In a further embodiment, a cross arm is broken or snapped off cleanly from the wall 170, such that the wall is generally smooth or continuous where the cross arm was removed, one example of which is shown in FIG. 2B. It will be understood that while bottom clips can be used on the bottom side of a shelving assembly, this does not preclude use on the top side. Such use would provide the same benefits as a use on the bottom side, such as, for example, giving the top side the same flat, smooth appearance as the bottom side. The cross arms can be snapped off or broken off at any time during construction of an assembly.

Referring to FIG. 8, it can be seen that after the bottom clips 500 have been attached to the front edge 210 and rear edge 220 of the panels forming the cell floors 132 on the bottom side 20, and the cross arms 310 are connected, additional panels 200 can be inserted into the offsets 165 at either end of the channel 160 in both of the bottom clips for forming the lower side walls 134 of the hexagonal cells. Alternatively, additional panels can be inserted into the offsets of the bottom clips prior to the cross arms being attached. Step 2 and Step 3 in FIG. 8 demonstrate one example of the panels being inserted into the offsets 165 and the cross arms being connected. Since the angle of the offsets can position the side edges 230 of the panels close together, it can be helpful, though not required, to attach the panels in the offsets prior to connecting the locking mechanisms.

After the floors 132 of the bottom side hexagonal cells and the lower side walls 134 are connected, the upper side walls 136 can be attached with another connecting component 155. The upper side walls can form a 120° interior angle with the lower side wall to create the hexagonal shaped cell. In one embodiment, a side clip 400 can be used to connect the upper side wall and lower side wall to form the 120° angle. In one embodiment, a side clip has two offsets 165, fixedly attached, as shown for example in FIGS. 5A and 5B, so that a 120° angle is formed therebetween. Side clips can be used on the front face 30 and the back face 40 to secure the panels. When used on the front face, the front corners 215 on each side of the front edge 210 of the lower side wall 134 can be engaged with one of the offsets in the side clips. Likewise, when used on the rear edge 220 the rear corners on each side of the rear edge can be engaged with one of the offsets in the side clips. Once engaged with the lower side wall, the clips engaged with the each of the corners will have another offset directed towards the top side 10 and at a 120° angle with the offset engaged with the lower side wall. Panels can be engaged with each of these offsets, in a similar fashion as the lower side wall, as shown, for example, in Step 6 in FIG. 8, to create the upper side walls 136. With the upper side walls in place, the offsets in each side clip are now engaged with a panel to hold the 120° angle.

The cover side 138 panel that can complete the hexagonal cell 130 can be engaged with the upper side walls 136 with a front clip 500 and a back clip 600, used in either order. A front clip and a back clip are substantially similar to a bottom clip 300. In one embodiment, a front clip has a channel 160 for receiving one of the edges of a panel. In a further embodiment, the front clip has one offset at either end of the channel, where the offsets are directed towards the top side 10. Each offset forms a 120° angle with the channel, as shown, for example, in FIGS. 6A-6F and 7A-7D. In yet a further embodiment, a front clip has a second offset at either end of the channel, where these offsets are directed towards the bottom side 20, as shown, for example in FIGS. 6A-6F and 7A-7D. The second offset is directed towards the bottom side 20 and also forms a 120° angle with the channel. This is also illustrated in FIGS. 6A-6F and 7A-7D. The two offsets at either end of the channel form offset pairs 550 that can be used to engage with the upper side walls of already constructed hexagonal cells. The front edge of a panel can be inserted into the channel 160 of the front clip to form the front face of the hexagonal cell.

The position of the offset channels 165 of a front clip can be changed to create different shaped cells. Additional offset channels can also be incorporated. For example, by utilizing two offset pairs at each end of the channel and changing the internal angle between each offset and a channel, a shelving assembly can be constructed having triangular shaped cells 130, such as shown for example in FIGS. 14A and 14B. Alternatively, a front clip can have an offset pair at each end that are directly opposite to each other, such that both are perpendicular to the channel and collier with each other, as shown, for example in FIG. 15B. A shelving assembly constructed, as described above, using this type of connecting component will have square shaped cells 130, as shown in FIG. 15A.

Figures 14A, 14B:
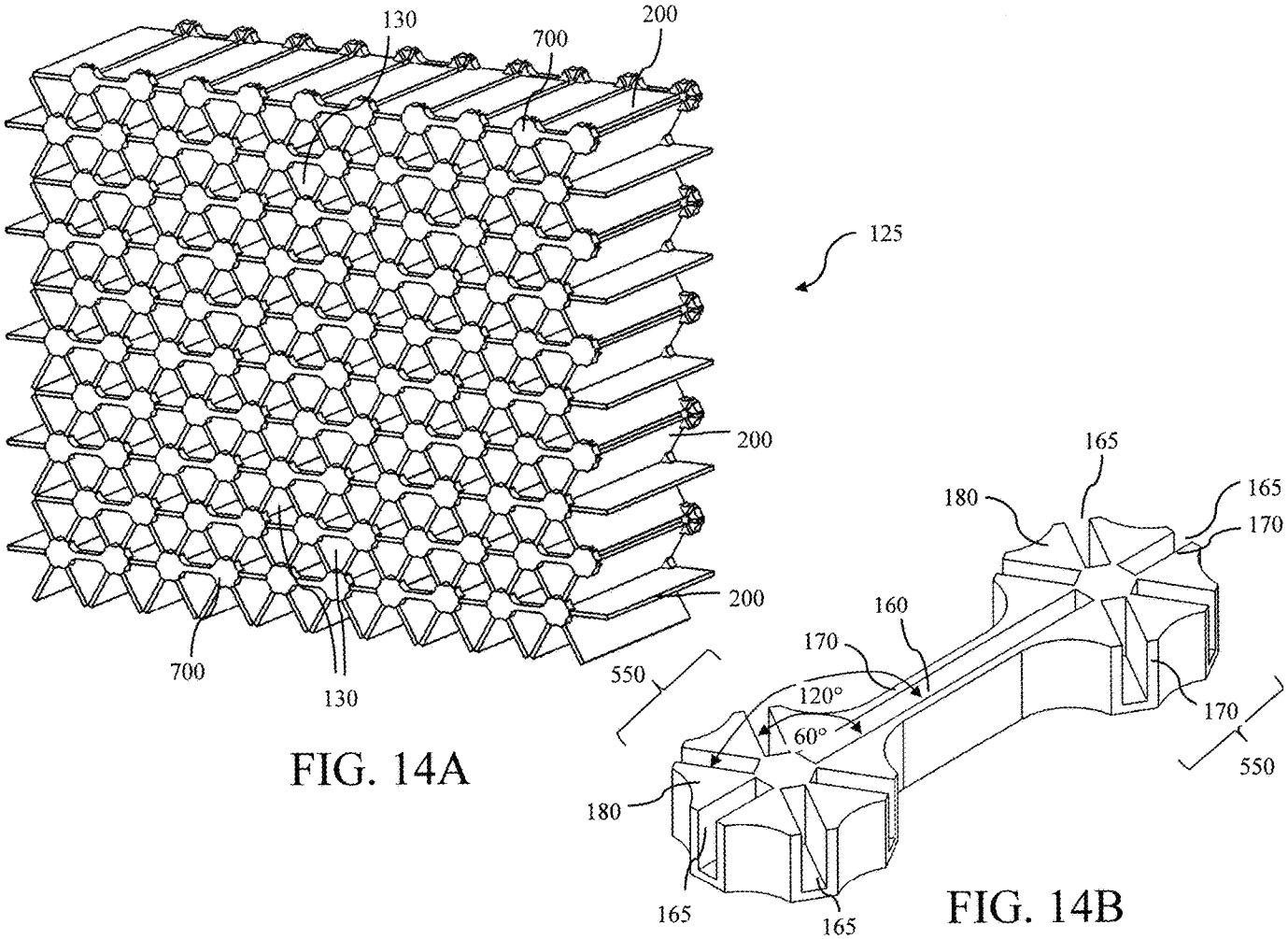
FIGS. 14A and 14B illustrate an embodiment of a clip for constructing a shelving assembly with interconnected triangular cells.

In one embodiment, a triangular front clip 700 can be used to construct a shelving assembly 125 with triangular shaped cells, such as shown, for example, in FIG. 14A. A triangular front clip can have one channel 160 and at least five radiating offsets 165 at either end of the channel. One offset can be colliner with the channel 160. One offset pair 550 at each end of the channel can be directed towards about the top side 10 and another offset pair 550 at each end of the channel can be directed towards about the bottom side 20. FIG. 14B illustrates a non-limiting example of a triangular front clip with this arrangement of offsets. In each offset pair, the angle formed between the first offset and the second offset and the channel 160 can be about 60° and about 120°, respectively, which is illustrated in FIG. 14B. Three or more panels can be attached utilizing a triangular front clip. Advantageously, a triangular front clip can be used on the front face 30 and the back face 40 of a shelving assembly. Thus, with this embodiment, a single type of connecting component can be used to construct an entire shelving assembly.

Using a first offset in each offset pair, directed at either the top side or the bottom side, and the channel, panels inserted therein can form a triangular cell as shown, for example, in FIGS. 14A and 14B. Panels inserted into the second offset in each offset pair can form adjacent interconnected triangular cells. And panels inserted into the second offset pair, opposite to the first offset pair, on each end of the channel can form a triangular cell beneath the first triangular cell, again, as shown in the example in FIG. 14A.

With this embodiment of a triangular front clip 700, a shelving assembly 125 with triangular shaped cells can be constructed similarly as described above for a shelving assembly with hexagonal shaped cells. The triangular front clip can be used for connecting an entire shelving assembly, such that the triangular front clip can be used as a front clip, bottom clip, and a back clip, described below. With the triangular front clip, a side clip is not required, as all of the corners can be engaged with a triangular front clip. However, a side clip can be used if other cell shapes are being integrated into the shelving assembly.

In an alternative embodiment, a square connecting component 800 can be used to construct a shelving assembly 125 with square shaped cells, as shown, for example, in FIG. 15A. A square front clip can have one channel 160 and three offsets 165 at either end of the channel. One offset can be collinear with the channel. A first offset 866 at each end of the channel can be directed at the top side 10 and a second offset 867 at each end of the channel can be directed at the bottom side 20, as shown, for example, in FIG. 15B. With this embodiment, the internal angle between the channel and an offset can be about 90° and the angle between the two offsets can be about 180°. Panels 200 inserted into the offsets can construct a shelving unit with interconnected square shaped cells, as shown, for example, in FIG. 15A.

With this embodiment of a square front clip 800, a shelving assembly 125 with square shaped cells can be constructed similarly as described above for a shelving assembly with hexagonal shaped cells. Advantageously, a square front clip can be used on the front face 30 and the back face 40 of a shelving assembly. Multiple square front clips can be used to construct an entire shelving assembly, such that the square front clip can be used as a front clip, bottom clip, and a back clip, described below. With the square front clip, a side clip is not required, as all of the corners can be engaged with a square front clip. However, a side clip can be used if other cell shaped are being integrated into the shelving assembly.

For construction of embodiments of a hexagonal cell shelving assembly, a front clip 500 can be used on both the front face 30 and the back face 40 to secure the hexagonal cells. In an alternative embodiment, a back clip 600 can be used on the back face. A back clip 600 is substantially similar to a front clip in that there is a channel 160 and an offset pair 650 at either end of the panel, where each offset forms a 120° angle with the channel. In a further embodiment, a back clip has a support arm 675 extending from at least one end. A support arm can extend out from the wall 170 at either end of a back clip, as shown, for example, in FIG. 11. In a specific embodiment, a support arm is substantially coplanar or collinear with the channel 160 of a back clip, which can be seen by way of example, in FIG. 11. The support arms can also have various decorative shapes or features to enhance their appearance. For example, a support arm could have a non-linear shape.

As mentioned previously, hexagonal cells that are interconnected form a three-dimensional structure of stacked cells that alternate with the ones next to it. So, the vertical columns line up, but the individual cells alternate with the cell in the one or more columns next to it. In one embodiment, a support arm 675 of one back clip 600 can overlap a support atm of another back clip that is beside or aligned with it, usually attached to another panel 200. Where the arms overlap they can cross the back face opening 139 of a whole or partial hexagonal cell, as shown, for example, in Steps 7 and 8 in FIG. 8.

In a further embodiment, overlapping supports arms 675 have one or more locking mechanisms 320 by which the support arms can be linked or joined together, similar to those that can be utilized on cross arms 310. The factors and options that can be considered by those skilled in the art with regard to the choice of locking mechanism utilized for a cross arm have been discussed above and are reasserted here with regard to a support arm. Variations in a locking mechanism utilized on a support arm that provide the same function with substantially the same results are within the scope of this invention.

Figure 11:
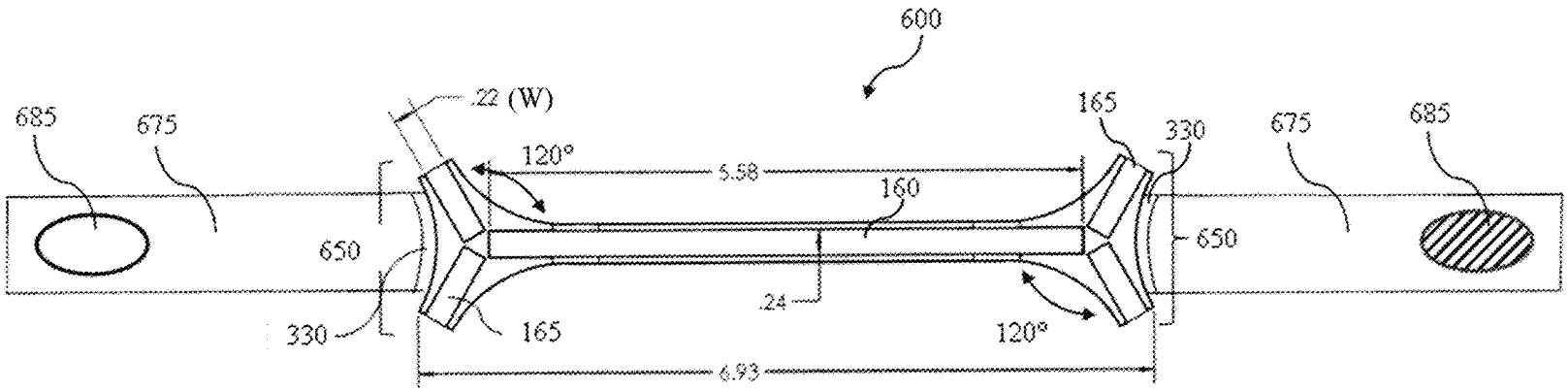
FIG. 11 is a front face view of an embodiment of a front clip with the cross arms attached, according to the subject invention.

Furthermore, when back clips 600 are used along the outside of a shelving assembly, the support arms can extend out past the hexagonal cell. It can be desirable to remove those protruding support arms. In a further embodiment, the supports arms have a frangible crease 330 at or near to the wall 170, one example of which is shown in FIG. 11. The frangible crease can be used to break or snap off a support arm from the back clip. The factors and options that can be considered by those skilled in the art with regard to the use of a frangible crease utilized for a cross arm have been discussed above and are reasserted here with regard to a support arm. Variations in frangible creases utilized on a support arm that provide the same function with substantially the same results are within the scope of this invention.

To complete assembly of a hexagonal cell, the channel 160 of a back clip 600 can be engaged with the rear edge 220 of a panel and the bottom offsets in each offset pair 500 can be engaged with the rear edge corners 225 of the panels that make the upper sidewalls 136. If a front clip has already been engaged with a panel, as described above, this can complete the cover side 138 of a hexagonal cell. In FIG. 8, Step 9 illustrates the procedure for attaching a front clip 500 and a back clip 600 to a panel 200 to create a cover side 138 and complete a hexagonal cell 130.

Another feature that can be utilized to add strength to a shelving assembly of the subject invention and, in particular, to the connecting components 155, is gussets 180. Gussets are panels of material affixed to a corner to add strength to two attached components. Gussets can be used on connecting components for constructing shelving assemblies with hexagonal cells, triangular cells, and square cells. FIGS. 10, 7A, 7B, 9, 4A, 4B, 14A, and 15A illustrate examples of gussets used on the different types of connecting components of the subject invention. A person with skill in the art will be able to determine the appropriate dimensions for a gusset and such variations are within the scope of this invention.

As taught above, panels can be inserted into the connecting components 155 in order to construct a shelving assembly. The ease with which the panels can be engaged with the channels 160 and offsets 165 can depend upon the dimensions of both. However, the process of engaging the panels and connecting components can be facilitated if the channel edges 161 and the offset edges 166 are beveled, filleted, chamfered, or otherwise slightly widened where they open for receiving a panel. FIGS. 6A, 6B, 9, and 10 illustrate non-limiting examples of channel edges and offset edges that have been widened by chamfering the edges that the panel engages with. A person with skill in the art can determine the appropriate type of widening technique to use and the appropriate amount of widening necessary for a channel edge and an offset edge. Such variations are within the scope of this invention.

When panels 200 are engaged with the connecting components 155, it can be beneficial if the corners of the panel are initially inserted into the channels 160 or offsets 165. With offsets, the panels can be completely inserted and "seated" with ease, because the offsets are typically, though not required to be, shorter in length than the channel. When inserting a panel into a channel, a corner of the panel can be inserted into the channel first and then the panel can be rotated so that it slides into the remaining length of the channel. It can be preferable for the corner of the panel to be inserted nearer to one end of the channel, so that when the panel is rotated the opposite corner is aligned to slide into the opposite end of the channel.

Figure 4A:
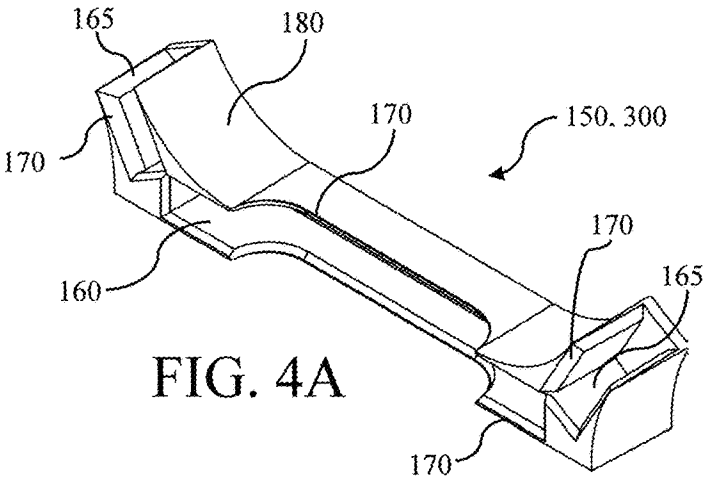
FIGS. 4A, 4B, 4C, and 4D show different views of another embodiment of a bottom clip, without cross arms, according to the subject invention. In this embodiment, the offsets and channel are wider than the embodiment shown in FIGS. 4A-4D.
Figure 4D:
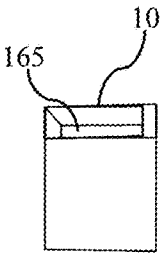
Figure 4C:
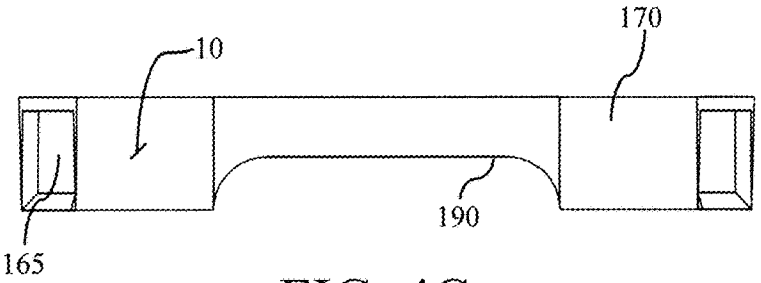
Figure 4B:
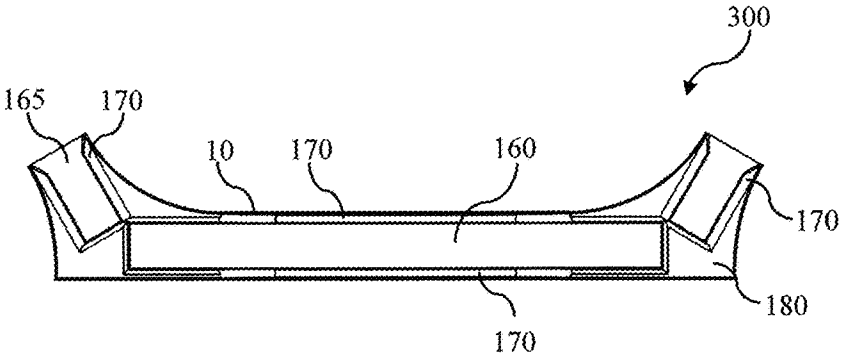

In one embodiment, the walls 170 that define the channel are formed with anti-warp indents 190, where some portion of the walls is narrower. In a further embodiment, the narrower area is at or near the center of the connector and the channel 160, such that the areas nearer the ends of the channel are wider. FIGS. 3C, 4C and 6C provide examples of this embodiment, where the walls are narrower at the center and gradually widen towards either end. Beneficially, during construction of a shelving assembly, this anti-warp indent in the walls can also encourage assembling the shelving parts by inserting a corner nearer the wider end of a channel, which makes rotating and seating the opposite ends of the panel and the channel easier.

Furthermore, there are numerous methods and techniques by which the connecting components 155 of the subject invention can be manufactured, including injection molding. The anti-warp indent can be advantageous in the injection molding process for inhibiting warpage, a common issue with this type of process. Warpage is a deformation that occurs in molded components when there is uneven shrinking or cooling. It can cause a twisted or bent shape, particularly in large surface areas of a component. The anti-warp indent acts to reduce the surface area of the channel walls and inhibit this deformation. Advantageously, this can also ensure that the connecting components and the channels therein maintain a linear form, which can be easier to install on the panel ends.

Shelving units are ubiquitous in homes, businesses, and industries. When selecting a shelving assembly, the primary concerns include whether it can fit into the desired space and whether it can be quickly and easily assembled, with minimal tools. The sturdiness of the final assembly can also be of particular concern for certain uses. The subject invention provides shelving assemblies that are customizable in shape and size and that can be assembled without any additional tools. The shelving assembly is formed of hexagonal cells, which structure can provide significantly more strength than typical shelving units with horizontally and vertically aligned components.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and other publications referred to or cited herein are incorporated by reference in their entirety, including all figures and tables, to the extent they are not inconsistent with the explicit teachings of this specification. Additionally, the entire contents of the references cited within the references cited herein are also entirely incorporated by reference.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

The invention claimed is:

1. A shelving assembly of shelving parts comprising:

a plurality of panels having a front edge with two front corners and a rear edge with two rear corners, and a side edge between each of the front corners and rear corners; and, multiple connecting components each comprising a single continuous channel for receiving at least one of a) the front edge and two front corners of one of the panels and b) the rear edge and two rear corners of one of the panels and further comprising at least one offset at each of two ends of the single continuous channel for receiving at least one of a) the front corners and b) the rear corners of another of the panels, such that, when two or more of the connecting components engage with the front edge and front corners and rear edge and rear corners of the plurality of panels, the side edges of the panels are parallel, whereby the shelving parts are engaged to form a shelving assembly comprising two or more interconnected cells each with a front face opening and a back lace opening.

2. The shelving assembly, according to claim 1, wherein the at least one a offset at each end of the single continuous channel forms a 120° angle with the single continuous channel.

3. The shelving assembly, according to claim 1, wherein a least one of the multiple connecting components comprises at least two offsets at each of the two ends of the single continuous channel, such that there is an offset pair at each end of the single continuous channel, where each of the two offsets in an offset pair form a 120° angle with the single continuous channel.

4. The shelving assembly, according to claim 2, further comprising at least one cross-arm extending from the at least one offset.

5. The shelving assembly, according to claim 4, further comprising a frangible crease in the at least one cross arm, such that the cross arm is detachable from the connecting component.

6. The shelving assembly, according to claim 5, further comprising a locking mechanism on the at least one cross arm, such that the locking mechanism is coupled to the locking mechanism on a cross arm of another connecting component on the shelving assembly.

7. The shelving assembly, according to claim 3, further comprising at least one support arm extending from between the pair of offsets at the end of the single continuous channel.

8. The shelving assembly, according to claim 7, further comprising a frangible crease in the support arm, such that the support arm is detachable from the connecting component.

9. The shelving assembly, according to claim 8, further comprising a locking mechanism on each support arm, such that the locking mechanism is coupled to the locking mechanism on a support arm of another connecting component on the shelving assembly.

10. The shelving assembly, according to claim 1, wherein a connecting component comprises at least three offsets at each end of the single continuous channel.

11. The shelving assembly, according to claim 10, wherein at least one of the three offsets is collinear with the single continuous channel and at least two other offsets form a 90° angle with the single continuous channel.

12. The shelving assembly, according to claim 1, wherein a connecting component comprises at least five offsets at each end of the single continuous channel.

13. The shelving assembly, according to claim 12, wherein at least one of the offsets is collinear with the single continuous channel, at least two of the offsets form a 60° angle with the single continuous channel, and at least two other offsets form a 120° angle with the single continuous channel.

* * * * *